United States Patent [19]

Budd

[11] 4,195,370

[45] Apr. 1, 1980

[54] APPARATUS FOR REELING AND UNREELING POOL COVERS

[75] Inventor: Joe A. Budd, Spokane, Wash.

[73] Assignee: Budd-Ke Enterprises, Inc., Spokane, Wash.

[21] Appl. No.: 941,548

[22] Filed: Sep. 12, 1978

[51] Int. Cl.[2] ..... E04H 3/16; E04H 3/18

[52] U.S. Cl. ..... 4/172.14

[58] Field of Search ..... 4/172.12, 172.14, 172.11; 242/55

[56] References Cited

U.S. PATENT DOCUMENTS

| | | | |
|---|---|---|---|
| Re. 25,078 | 11/1961 | McGuire | 4/172.14 |
| 2,958,083 | 11/1960 | Shook et al. | 4/172.14 |
| 3,019,450 | 2/1962 | Karasiewicz | 4/172.14 |
| 3,050,743 | 8/1962 | Lamb | 4/172.14 |
| 3,070,811 | 1/1963 | Bender | 4/172.14 |
| 3,074,079 | 1/1963 | Issaacson | 4/172.14 |
| 3,271,788 | 9/1966 | Bender | 4/172.14 |
| 3,273,171 | 9/1966 | Lamb | 4/172.14 |
| 3,277,498 | 10/1966 | Kleinbard et al. | 4/172.14 |
| 3,426,366 | 2/1969 | Bailey et al. | 4/172.14 |
| 3,574,979 | 4/1971 | Chan | 4/172.12 |
| 3,613,126 | 10/1971 | Granderath | 4/172.14 |
| 3,747,132 | 7/1973 | Foster | 4/172.14 |
| 3,885,255 | 5/1975 | Vorbach | 4/172.14 |
| 4,001,900 | 1/1977 | Lamb | 4/172.14 |
| 4,060,860 | 12/1977 | Lamb | 4/172.14 |

*Primary Examiner*—Houston S. Bell, Jr.
*Attorney, Agent, or Firm*—Wells, St. John & Roberts

[57] ABSTRACT

An apparatus for reeling and unreeling a flexible cover sheet for a swimming pool. The apparatus has two wheel supported carriage frames at opposite ends of an elongated drum and a stabilizer tube. The elongated drum is coaxial with a front pair of wheels and rotates independently of the wheels. A stabilizer tube is coaxial with a rear set of wheels in unison with them. A drive assembly on one of the carriage frames is operatively connected to the drum. It may be manually operated to reel an elongated flexible pool cover onto the drum. As this is done the cover will pull the carriages along a straight path to the point of connection of the cover end. The carriages are moved outwardly from the fixed cover end to play out the cover over the pool. Both the cover and the rear pair of wheels serve to maintain the drum in a perfect transverse orientation relative to the length of the pool cover sheet so the carriage will track straight and the cover will roll evenly onto the drum.

6 Claims, 5 Drawing Figures

APPARATUS FOR REELING AND UNREELING POOL COVERS

BACKGROUND OF THE INVENTION

The present invention is related to apparatus for placing and removing a flexible elongated cover over a large area such as a swimming pool and more particularly to such devices that will take up or play out the flexible cover from a rotatable drum movably carried along the length of the area to be covered.

It has long been desirable to provide flexible covers for swimming pools both as a safety measure and to prevent debris from entering the pool when not in use. A more recent development includes the further use of such covers for solar heating of the pool water.

Swimming pool covers are typically large thin rectangular plastic sheets. They are bulky and difficult to handle. Several mechanisms have been developed in response to the problem of storing and handling such covers. Most are formed as an integral part of the swimming pool. The cover might be held on a stationary roll at one end of the pool and the free cover end is played out along tracks on opposite sides of the pool to the covered position. This appears to be functional, but many pools are manufactured without the provision of a pool cover and many others cannot be easily modified to include an integral form of pool cover and handling assembly.

Others have approached the problem of storing and placing swimming pool covers by providing a reel or reels upon which the cover is wound. The problem with such an apparatus is alignment or control of the movement of the reel. The span is usually substantial between carriages holding the cover roller. If one carriage advances forward of the other, the cover will begin to roll unevenly and the problem will magnify as the carriages and reel approach the connection point for the cover. One remedy for this problem has been to pull the carriage by the cover as it is wound onto the gathering drum. However, the forms of pool covers presently being used are constructed of plastic material that may stretch. Therefore, if one side of the material is stretched beyond the length of the other side, the result is that the cover will roll unevenly and cause misalignment of the drum.

It therefore becomes desirable to obtain some simple and inexpensive device for placing and gathering swimming pool covers that will accurately and consistently roll and unroll the cover in a straight path over the pool area.

DETAILED DESCRIPTION OF A PREFERRED EMBODIMENT

Figure 1:
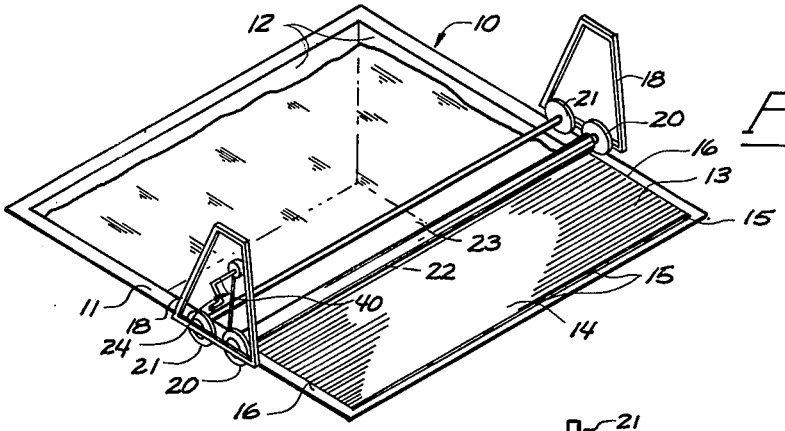
FIG. 1 is a pictorial view diagrammatically illustrating the present apparatus in relation to a swimming pool.
Figure 2:
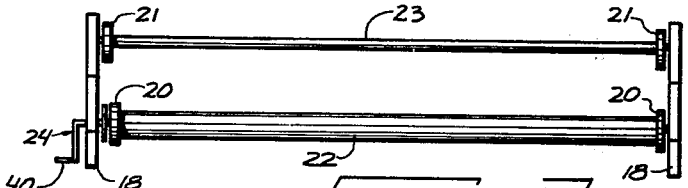
FIG. 2 is a plan view of the apparatus.

A swimming pool is indicated in the accompanying drawings by the reference character 10. The pool 10 is of standard configuration including a horizontal top surface 11 and vertical side edges 12 leading to the pool bottom. An elongated rectangular cover 13 is provided to cover the area spanned by the pool when the pool is not in use.

The cover 13 is typically constructed of synthetic resin sheet material in an elongated rectangular configuration. It includes an end 14 that may be fastened at 15 to one end of the pool. Opposed longitudinal side edges 16 of the cover 13 are preferably oriented parallel to the side edges 12 of pool 10.

It is the purpose of the present invention to manually reel and unreel the swimming pool cover 13 to selectively expose or cover the swimming pool area while maintaining the cover side edges 16 parallel with the pool side edges 12.

The present apparatus includes opposed carriage frames 18 that are spaced on opposite sides of the swimming pool 10. The carriage frames 18 are each movably supported by a pair of wheels, including coaxial front wheels 20 and coaxial rear wheels 21. The wheels 20 and 21 are interconnected by an elongated drum 20 and a stabilizer tube 23. The drum 22 interconnects the forward wheels 20. It is coaxial with the front wheels 20 but is free to rotate independently of them. The stabilizer tube 23 extends between the rearward wheels 21. It is rigidly connected to the wheels 21 and rotates only in unison with both rear wheels 21.

A drive means 24 is provided on one of the carriage frames 18 to facilitate manual reeling and unreeling of the cover on drum 22. Movement of the carriages along the pool surface is accomplished by (1) pushing the carriages to unreel the cover and by (2) reeling the cover onto the drum 22. The carriages are automatically pulled along toward the cover end 14 as the drum is rotated by the drive means 24.

Figure 4:
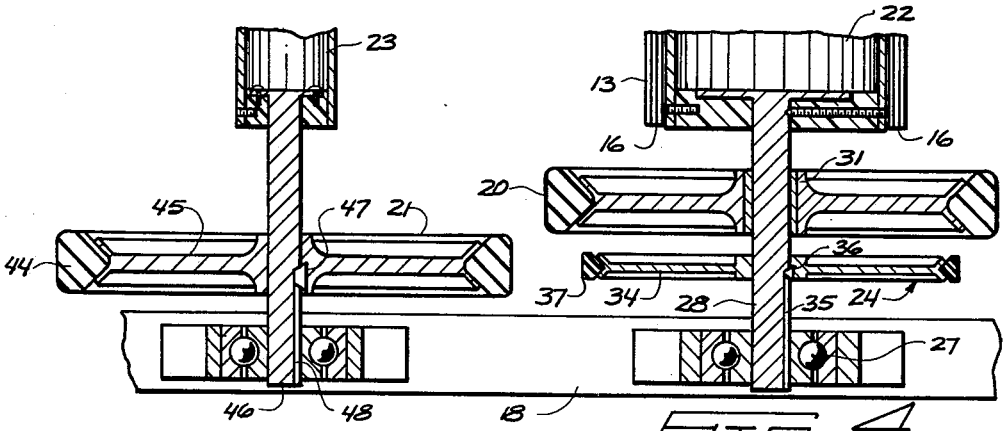
FIG. 4 is an enlarged sectional view taken substantially along line 4—4 in FIG. 3.

Drum 22 is shown in substantial detail in FIG. 4. It is rotatably mounted to the carriage frames 18 by forward bearings 27. These bearings 27 receive the ends of stub shafts 28 that extend outwardly from opposite ends of the drum 22. The forward reels 20 are freely rotatably mounted to the stub shafts 28 between the ends of drum 22 and carriage frames 18. A wheel bearing 31 is provided for each forward wheel 20 so it will rotate independently of the drum 22.

One of the carriage frames also mounts the drive means 24. Means 24 enables manual rotation of the drum 22 independently of the wheels 20. The drive means includes a driven pulley 34 that is affixed to the stub shaft 28 by means such as keyway 35 and key 36. Rotation of the driven pulley 34 will result in corresponding rotation of the drum 22. The front wheels 20 will not rotate in direct response to rotation of the driven pulley 34 since they are mounted on the bearings 27. In fact, the carriages may sit stationary while the drum 22 is rotated through operation of drive means 24. However, when the drum 22 is connected (by appropriate fastening mechanismsto the free end of cover 13, rotation of the drum 22 will wind the cover onto the drum. The winding of the anchored cover will then automatically pull the carriages in the direction of the fixed cover end 14.

The remainder of drive means 24 includes a belt 37 that extends from driven pulley 34 to frictionally engage a drive pulley 38. Drive pulley 38 is rotatably mounted to the associated carriage frame 18 by a bearing 39.

Pulley 38 is manually rotated through operation of a crank 40. Crank 40 includes a fitting 41 at one end. The fitting 41 will releasably mate with another fitting 42 at an end of the pulley shaft 43. The fittings allow the crank to be removed and stored in a hanger 44 on the adjacent carriage frame. It may be noted that the drive pulley 38 is positioned elevationally above the driven pulley 34 and wheels 20 and 21. The elevation of pulley 38 is at the approximate waist level of an operator. The operator may therefore stand upright while turning the crank 40.

The rear wheels 21 are also shown in substantial detail by FIG. 4. Wheels 21 include peripheral rubber tires 44 mounted on rigid rims 45. The rims fit over stub shafts 46 that extend from opposite ends of the stabilizer tube 23. A key 47 and keyway 48 rigidly connect the rims 45 to the shaft 46. Rotation of one wheel 21 will cause corresponding rotation of the tube 23 and opposite wheel 21.

The rubber tires 44 frictionally engage the surface 11 of pool 10 and will not easily slide thereon. The interlocked wheels 21 and tube 23 can roll only along a straight path. They will therefore hold the carriages along a straight path as they are moved along the pool. This feature, combined with the tendency of cover 13 to pull itself straight toward its fastened end, assures that the cover will be rolled evenly on the first drum 22 consistently on each use. Even if the cover becomes stretched on one side, the wheels 21 and tube 23 will maintain proper alignment.

Additional guidance for the apparatus is provided by a pair of depending guide rollers 55. These rollers are supported on downwardly projecting brackets 56 on each carriage frame 18. They may be adjusted inwardly and outwardly relative to the side edges 12 by a nut and bolt arrangement 57. The rollers 55, when in operation, rotatably engage and roll over the vertical side edges 12 of the pool while the cover is being reeled onto and off of the drum 22.

Figure 5:
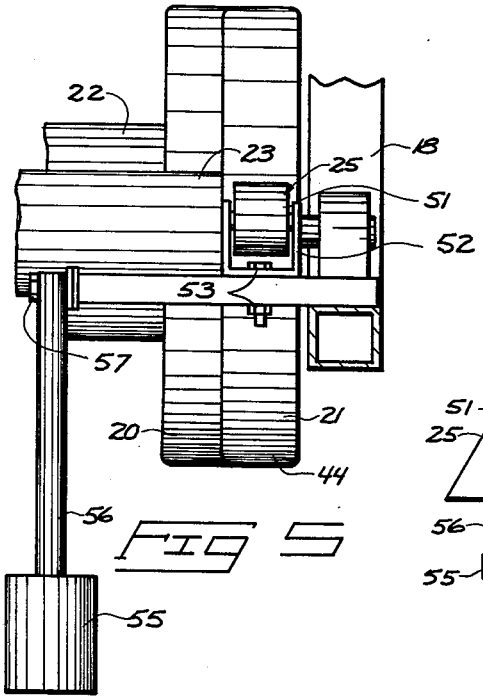
FIG. 5 is a sectional view taken substantially along line 5—5 in FIG. 3.
Figure 3:
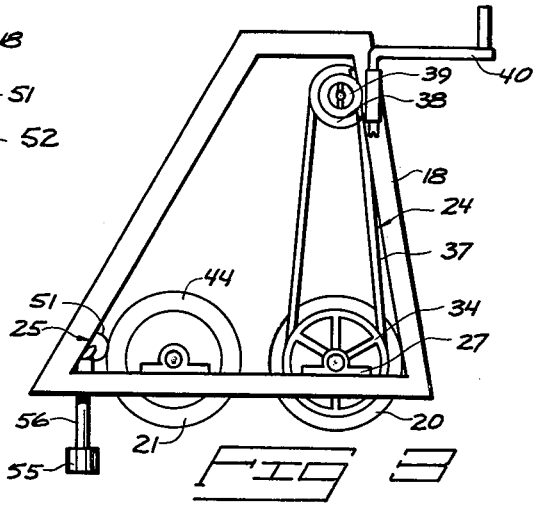
FIG. 3 is an enlarged end elevational view.

A brake means 25 (FIG. 5) is provided to selectively resist movement of the carriage by resisting rotation of the rearward wheels 21. It includes a roller 51 mounted by a bracket 52 on each carriage frame 18. The rollers 51 are urged against the rearward wheels 21 to resist rotation of the wheels continuously in either direction of rotation. A nut and bolt arrangement 53 may be provided to mount the bracket and to facilitate adjustment of the force applied by the roller to the rearward wheels 21. Brake means 25 will prevent free rolling motion of the carriage as the cover is played out. It will also keep the cover taut as it is being reeled up.

The present apparatus may be quickly and easily operated by one person. For example, if the operator wishes to cover a pool 10 he may simply push the carriages from one side or the other toward the end of the pool opposite the attached cover end 14. The cover will unroll from the drum 22 automatically as the carriages move toward the opposite pool end. The carriages will move in a straight path along the pool because of (1) the rigid connection between the rear wheels 21 and tube 23; and (2) through the assistance of the guide rollers 55. The pool cover cannot be relied on during the unreeling operation to aid in maintaining alignment of carriages because of its flexible nature.

When the operator wishes to uncover the pool, he simply connects the crank 40 to the drive pulley 38 and turns the crank to roll the cover onto the drum 22. As the cover collects on the rotating drum 22, the carriages are automatically pulled in a forward direction against the resistance offered by the brake means 25. The alignment is maintained this time through the tube 23 and rearward wheels, the guide rollers 55, and by the cover itself since it is now under even tension along drum 22.

It is noted that the above description and drawings are given to set forth an example of a preferred form of the present invention. Only the following claims, however, found at the end of this specification are to be taken as strict definitions of my invention.

What I claim is:

1. An apparatus for reeling and unreeling a flexible swimming pool cover, comprising:

a pair of carriage frames;

a pair of wheels on each frame, each pair of wheels including a front wheel and a rear wheel mounted to the frame, the respective front and real wheels of the frames being coaxial and rotatably mounted to the frames about parallel transverse axes;

an elongated drum extending between the carriage frames and rotatably mounted thereto for coaxial rotation about the axis of the front wheels;

said front wheels being rotatable independently of said drum;

a stabilizer tube extending between the carriage frames, said tube being operably fixed to the rear wheels for rotation in unison with the rear wheels;

drive means operatively associated with the drum for rotating the drum about its axis independently of the front wheels;

said drum being adapted to be connected to one end of a swimming pool cover; and brake means engaging one of the wheels on each carriage frame for causing the wheel to continuously resist rotation about its axis.

2. The apparatus as defined by claim 1 further comprising depending guide rollers on the carriage frames for engaging a swimming pool on opposite wall surfaces thereof to guide the apparatus along the pool as the cover is being reeled and unreeled.

3. The apparatus defined by claim 1 wherein the drive means includes:

a drive pulley on one of the carriages;

a driven pulley at an end of the drum, adjacent the one carriage;

a crank mountable to the drive pulley to enable manual rotation of the drive pulley; and a belt interconnecting the drive pulley and driven pulley for transmitting rotation of the drive pulley to the driven pulley.

4. The apparatus as defined by claim 3 wherein the drive pulley is located at an elevation above the driven pulley to allow access by an operator while standing in an upright condition.

5. The apparatus as defined by claim 1 wherein the brake means is comprised of a roller mounted to each carriage and rotatably urged against one of the wheels thereon to continuously resist rotation of the engaged wheel and thereby keep a pool cover taut as it is being rolled onto the first drum.

6. The apparatus as defined by claim 5 further comprising depending guide rollers on the carriages for engaging a swimming pool on opposite wall surfaces thereof to guide the apparatus along the pool as the cover is being rolled and unrolled.

* * * * *